US007376364B2

(12) United States Patent
Fujita

(10) Patent No.: US 7,376,364 B2
(45) Date of Patent: May 20, 2008

(54) IMAGE FORMING APPARATUS

(75) Inventor: Masahiko Fujita, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 216 days.

(21) Appl. No.: 11/226,426

(22) Filed: Sep. 15, 2005

(65) Prior Publication Data

US 2006/0056862 A1 Mar. 16, 2006

(30) Foreign Application Priority Data

Sep. 16, 2004 (JP) ..... 2004-269581

(51) Int. Cl.
*G03G 15/00* (2006.01)

(52) U.S. Cl. ..... 399/16; 399/396; 399/18; 399/19; 271/4.02

(58) Field of Classification Search ..... 399/16, 399/18, 19, 396; 271/4.02
See application file for complete search history.

(56) References Cited

U.S. PATENT DOCUMENTS 4,874,958 A * 10/1989 Sampath et al. ..... 399/16
5,018,718 A * 5/1991 Matsuno et al. ..... 271/245
5,963,770 A * 10/1999 Eakin ..... 399/364
6,021,284 A * 2/2000 Serizawa et al. ..... 399/8
6,381,441 B1 * 4/2002 Byeon et al. ..... 399/396
6,540,219 B1 * 4/2003 Naruse et al. ..... 271/37

FOREIGN PATENT DOCUMENTS

JP 3-119854 A 5/1991
JP 11-249525 A 9/1999
JP 2003-206044 A 7/2003

* cited by examiner

*Primary Examiner*—Judy Nguyen
*Assistant Examiner*—Andy L Pham
(74) *Attorney, Agent, or Firm*—Birch, Stewart, Kolasch & Birch, LLP

(57) ABSTRACT

An image forming apparatus includes a sheet feeding cassette, transport rollers, a pick-up roller, a sheet detector, and a control section. The sheet feeding cassette stores sheets for developer images to be transferred thereonto at a secondary transfer position. The transport rollers transport a sheet at variable speeds along a sheet transport path which extends from the cassette to the secondary transfer position. The pick-up roller feeds a sheet into the sheet transport path. The sheet detector detects whether a sheet is fed from the cassette. When the detector detects that a sheet is not fed, the control section controls the pick-up roller to feed the sheet again. The control section varies respective transport speeds of the pick-up roller, a sheet feed roller, and the transport rollers, according to number of attempts to feed the sheet.

13 Claims, 5 Drawing Sheets

| PROCESS SPEED mm/s | SHEET TRANSPORT SPEED mm/s | | | |
|---|---|---|---|---|
| | FAILURE 0 time (NORMAL) | FAILURE 1 time | FAILURE 2 times | FAILURE 3 times |
| | SPEED A | SPEED B | SPEED C | SPEED D |
| 125 | 187.5 | 221 | 260 | 307 |

| PROCESS SPEED mm/s | SHEET TRANSPORT SPEED mm/s | | | |
|---|---|---|---|---|
| | FAILURE 0 time (NORMAL) | FAILURE 1 time | FAILURE 2 times | FAILURE 3 times |
| | SPEED A | SPEED B | SPEED C | SPEED D |
| 125 | 187.5 | 221 | 260 | 307 |

FIG. 3

IMAGE FORMING APPARATUS

CROSS REFERENCE

This Nonprovisional application claims priority under 35 U.S.C. § 119(a) on Patent Application No. 2004-269581 filed in Japan on Sep. 16, 2004, the entire contents of which are hereby incorporated by reference.

BACKGROUND OF THE INVENTION

The invention relates to image forming apparatus, such as printers, facsimile machines, or copying machines, which form an image on a sheet by transferring a developer image to the sheet. The invention further relates to a sheet transport method for transporting a sheet fed from a sheet storage.

Hereinafter a recording medium such as a sheet of paper or OHP film is collectively referred to as a sheet. In image forming apparatus, a sheet is transported through a sheet transport path to an image forming section which is positioned at an upper part of the apparatus. The sheet transport path extends vertically upward from a sheet feeding section to a transfer position where a developer image is transferred to the sheet. The sheet feeding section provided at a lower part of the apparatus has a plurality of sheet feeding cassettes arranged in tiers.

In an image forming process performed by the image forming apparatus, sheets stored in a selected one of the sheet feeding cassettes are fed, one at a time, into the sheet transport path with a device such as a pick-up roller. A sheet as fed is held by a pair of registration rollers, and is then delivered to the transfer position in a timely manner such that a developer image is properly transferred onto the sheet.

As described above, recent image forming apparatus generally have a vertical, and therefore short, sheet transport path which is fit for high-speed image formation. Such a vertical sheet transport path is also effective in downsizing image forming apparatus.

Depending on image forming apparatus with such vertical sheet transport path, however, a distance that a sheet is transported along the sheet transport path from the sheet feeding cassette to the transfer position is shorter than a distance that a developer image is transported from a developer image forming position to the transfer position. Therefore, formation of a developer image is initiated at an earlier timing than feeding a sheet is initiated. Accordingly, a delay in feeding a sheet prevents an already formed developer image from being transferred onto the sheet. The problem has a serious effect on an image formation process, particularly in a multi-color image forming apparatus using a tandem-type intermediate transfer method.

Such multi-color image forming apparatus has a plurality of image stations for forming developer images of respective colors. The image stations are arranged in alignment with one another. The developer images are sequentially superimposed on one another on an intermediate transferring carrier at respective intermediate transfer positions. The developer images as superimposed are then delivered to a transfer position. Because of a long distance between the transfer position and the intermediate transfer position which is most distant from the transfer position, formation of a developer image at the most distant intermediate transfer position needs to be initiated long before feeding a sheet for the developer image to be transferred to is initiated.

A sheet feeding failure sometimes occurs with developer images already formed in some of the image stations. To such failure, there are conventional solutions such as cleaning off untransferable developer images or delaying initiation of image forming processes (i.e., extending interval periods between image forming processes). However, the former solution has problems, such as of developer waste or of a recovering container getting shortly filled up with recovered developer. The former solution thus results in an increase in maintenance cost and therefore is uneconomical. The latter solution causes a decrease in image forming speed, i.e., a reduced number of image forming processes performed per unit time.

As another solution to sheet feeding failure, Japanese Laid-open Patent Application No. 2003-206044 discloses an image forming apparatus which, in the event of a failure in feeding a sheet, modulates pressure that a separating roller applies to the sheet, so that the separating roller refeeds the same sheet with an increased force.

Although the separating roller has an increased feeding force, a sheet transport speed is not increased in the sheet refeeding operation. Thus, the sheet takes a longer time to reach the transfer position than it takes under a condition where no sheet feeding failure occurs. Consequently, the sheet is prevented from being tranported to the transfer position in time for arrival of a developer image at the transfer position. Therefore, the developer image should be cleaned off, and a new developer image should be formed in order to be transferred to the sheet.

It is a feature of the invention to offer an image forming apparatus, and a sheet transport method, which allow a sheet to be transported in a timely manner for a developer image transfer operation, thereby preventing an increase in maintenance cost and a decrease in image forming speed.

SUMMARY OF THE INVENTION

An image forming apparatus of the invention includes: a storage device for storing sheets; a pick-up device for feeding a sheet from the storage device into a sheet transport path which extends from the storage device to a transfer position where a developer image is transferred to a sheet; a transporting device for transporting a sheet at variable speeds along the sheet transport path; a detecting device for detecting whether a sheet is properly fed from the storage device, the detecting device being positioned downstream of the pick-up device along the sheet transport path; and a control device for driving the pick-up device to feed a sheet again when the detecting device detects that said sheet is not fed into the sheet transport path and for varying rotation speed of the transporting device depending on number of attempts made to feed said sheet.

BRIEF DESCRIPTION OF THE DRAWINGS

FIG. 3 is a table illustrating relationships between sheet transport speeds of transport rollers and number of times of sheet feeding failures.

DETAILED DESCRIPTION OF THE INVENTION

Figure 1:
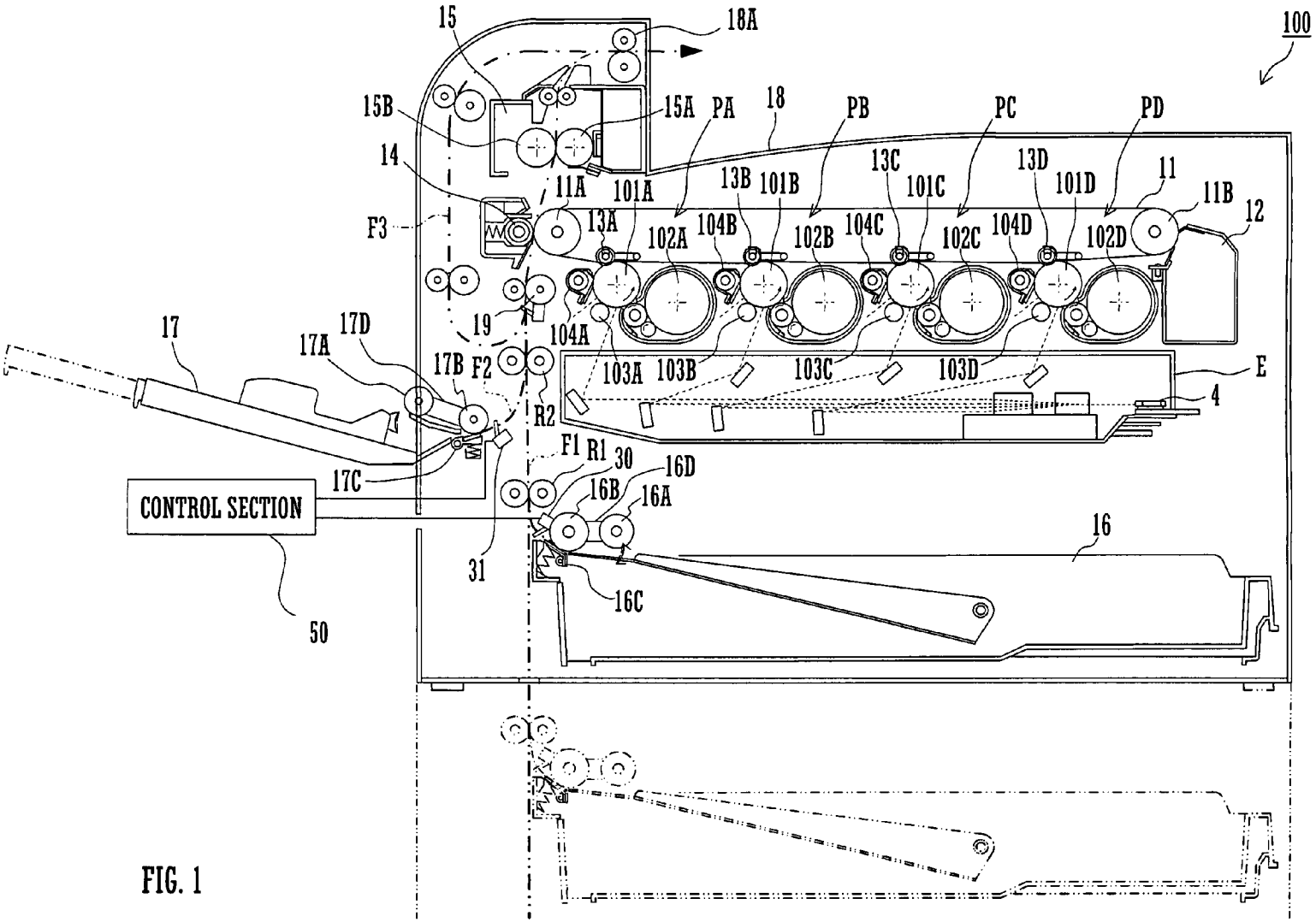
FIG. 1 is a cross-sectional view illustrating a schematic configuration of an image forming apparatus according to an embodiment of the invention.

FIG. 1 is a cross-sectional view illustrating a schematic configuration of an image forming apparatus according to an embodiment of the invention. An image forming apparatus 100 forms a color or monochromatic image on a sheet based on image data read from an original or on image data received though a network. The image forming apparatus 100 includes an exposure unit E, photoreceptor drums 101A to 101D, developing devices 102A to 102D, charging rollers 103A to 103D, cleaning units 104A to 104D, an intermediate transfer belt 11, primary transfer rollers 13A to 13D, a secondary transfer roller 14, a fusing device 15, sheet transport paths F1, F2, and F3, a sheet feeding cassette 16, a manual sheet feeding tray 17, and a sheet receiving tray 18. The sheet feeding cassette 16 and the manual sheet feeding tray 17 correspond to the storage device of the invention.

The apparatus 100 forms an image based on image data obtained by color separation from an original color image. The image data correspond to four colors, i.e., black (K) and the three subtractive primary colors—yellow (Y), magenta (M), and cyan (C), respectively. The image formation is performed at image stations PA to PD which are provided correspondingly to the four colors. Since the image stations PA to PD have similar configurations, the configuration of the image station PA for black color image formation is described below. The section PA has the photoreceptor drum 101A, the developing device 102A, the charging roller 103A, the primary transfer roller 13A, and the cleaning unit 104A. The image stations PA to PD are arranged in alignment with one another, along a direction in which the intermediate transfer belt 11 travels, i.e., along a sub scan direction.

The charging rollers 103A to 103D are contact-type chargers provided for charging respective outer circumferential surfaces of the photoreceptor drums 101A to 101D uniformly so that the surfaces have a predetermined electric potential. For the charging rollers 103A to 103D, contact-type chargers using a charging brush, or noncontact-type charging devices, are substitutable. The exposure unit E has a not-shown semiconductor laser, a polygon mirror 4, and not-shown reflecting mirrors. The exposure unit E shines laser beams modulated according to the image data for the four colors of black, cyan, magenta, and yellow, on the photoreceptor drums 101A to 101D, respectively. Thus, electrostatic latent images corresponding to the image data for the four colors are formed on the photoreceptor drums 101A to 101D, respectively.

The developing devices 102A to 102D feed toners to the respective surfaces of the photoreceptor drums 101A to 101D carrying the electrostatic latent images, so that the latent images are developed into toner images. More specifically, the developing devices 102A to 102D which store therein black, cyan, magenta, and yellow toners, respectively, develop the latent images formed on the photoreceptor drums 101A to 101D into black, cyan, magenta, and yellow toner images, respectively. The cleaning units 104A to 104D remove and collect residual toners on the respective surfaces of the photoreceptor drums 101A to 101D after developing and transferring operations.

The intermediate transfer belt 11 corresponds to an intermediate transferring carrier of the invention. The intermediate transfer belt 11 is stretched over a drive roller 11A and a driven roller 11B, to form a loop traveling path. As the intermediate transfer belt 11 travels, an outer circumferential surface thereof faces the photoreceptor drum 101D, the photoreceptor drum 101C, the photoreceptor drum 101B, and the photoreceptor drum 101A, in the order. The primary transfer rollers 13A to 13D are positioned to face the photoreceptor drums 101A to 101D, respectively, with the intermediate transfer belt 11 sandwiched therebetween. Respective positions where the intermediate transfer belt 11 faces the photoreceptor drums 101A to 101D are herein referred to as primary transfer positions. Each of the primary transfer positions corresponds to an intermediate transfer position of the invention.

To the primary transfer rollers 13A to 13D, a primary transfer bias is applied at a constant voltage for transfefling the toner images as carried on the photoreceptor drums 101A to 101D to the intermediate transfer belt 11. The primary transfer bias is opposite in polarity to the charge of the toners. Thus, the toner images for the respective colors are sequentially transferred on the outer circumferential surface of the intermediate transfer belt 11 and superimposed on one another, so that a full-color toner image is formed on the outer circumferential surface of the belt 11.

When image data for only some of the four colors are input, electrostatic latent image(s) and toner image(s) are formed only on some of the photoreceptor drums 101A to 101D, depending on the input color image data. In monochromatic image formation, for example, an electrostatic latent image and a toner image are formed only on the photoreceptor drum 101A corresponding to the color black. Accordingly, only a black toner image is transferred to the outer circumferential surface of the intermediate transfer belt 11.

Each of the primary transfer rollers 13A to 13D includes a metal (e.g., stainless steel) shaft of approximately 8 to 10 mm diameter. A surface of the metal shaft is coated with a conductive elastic material, e.g., EPDM or urethane foam, through which a high voltage is uniformly applied to the intermediate transfer belt 11.

The rotation of the intermediate transfer belt 11 feeds the full-color or monochromatic toner image as transferred thereto, to a secondary transfer position where the belt 11 faces the secondary transfer roller 14. The secondary transfer position corresponds to the transfer position of the invention. In image formation, the secondary transfer roller 14 is pressed at a predetermined nip pressure against the drive roller 11A, with the intermediate transfer belt 11 sandwiched therebetween.

As a sheet as fed from either the sheet feeding cassette 16 or the manual sheet feeding tray 17 passes between the secondary transfer roller 14 and the intermediate transfer belt 11, a high voltage opposite in polarity to the charge of the toners is applied to the secondary transfer roller 14. Thus, the toner image is transferred from the outer circumferential surface of the intermediate transfer belt 11 to a surface of the sheet.

A cleaning unit 12 collects residual toners remaining on the intermediate transfer belt 11 after the transfer operation in order to avoid mixture of toners of different colors in a subsequent image forming process.

The sheet with the toner image transferred thereto is led into the fusing device 15, and passes between a heat roller 15A and a pressure roller 15B in order to be heated and pressed. The toner image is thus firmly fixed to the surface of the sheet. The sheet with the fixed toner image is then ejected onto the sheet receiving tray 18 by sheet eject rollers 18A.

The image forming apparatus 100 has the sheet transport path F1 extending approximately vertically from the sheet feeding cassette 16, through a gap between the secondary transfer roller 14 and the intermediate transfer belt 11 and through the fusing device 15, to the sheet receiving tray 18. A portion of the sheet transport path F1 from the sheet feeding cassette 16 to the secondary transfer position corresponds to the sheet transport path of the invention.

Along the sheet transport path F1, a pick-up roller 16A, a sheet feeding roller 16B, a separating pad 16C, and transport rollers R1 and R2 are provided. The pick-up roller 16A picks up and feeds sheets which are stored in the sheet feeding cassette 16, one at a time, into the sheet transport path F1. If two or more sheets are picked up at a time, the separating pad 16C separates a top sheet from the other sheets so that only the top sheet is transported. The transport rollers R1 and R2, which correspond to the transporting device of the invention, transport the fed sheet along the sheet transport path F1. The rollers R1 and R2 are rotatable at variable speeds.

A sheet detector 30 is arranged immediately downstream of the separating pad 16C along the sheet transport path F1.

The sheet detector 30 corresponds to the detecting device of the invention. The detector 30 detects a sheet passing between the sheet feeding roller 16B and the separating pad 16C. More specifically, the detector 30 detects whether a sheet is properly fed into the sheet transport path F1 from the sheet feeding cassette 16 by the pick-up roller 16A. The detector 30 is connected to a control section 50 to output a detection result to.

As described above, the separating pad 16C, which is positioned immediately downstream of the pick-up roller 16A in the sheet transport direction, separates a top sheet from the other sheets if two or more sheets are picked up at a time by the roller 16A. The detector 30 is positioned immediately downstream of the separating pad 16C because the presence of the separating pad 16C renders an immediate downstream position thereof suitable for detection on whether a sheet is properly fed into the sheet transport path F1.

The positioning of the detector 30 allows quick and accurate detection on whether a sheet is fed from the sheet feeding cassette 16 and thus enables the pick-up roller 16A immediately to pick up the same sheet for refeeding. A lead sensor or a photosensor having a contact-type actuator, or a noncontact-type photosensor, is usable as the detector 30. In the present embodiment, a photosensor having a contact-type actuator is used as the detector 30.

The pick-up roller 16A and the sheet feeding roller 16B correspond to the pick-up device of the invention for feeding a sheet into the sheet transport path F1. The rollers 16A and 16B also correspond to the transporting device of the invention for transporting the sheet along the path F1.

The control section 50 corresponds to the control device of the invention. When the detector 30 detects that a sheet is not fed into the sheet transport path F1, the control section 50 drives the pick-up roller 16A again in order to refeed the same sheet. At the time, the control section 50 changes respective rotation speeds, i.e., transport speeds, of the pick-up roller 16A, the sheet feeding roller 16B, and the transport rollers R1 and R2, based upon a calculated number of attempts made to refeed the same sheet, as described later in detail.

Along the sheet transport path F1, registration rollers 19 and the sheet eject rollers 18A are also arranged. The registration rollers 19 lead the as-transported sheet between the secondary transfer roller 14 and the intermediate transfer belt 11 at a predetermined timing. The sheet eject rollers 18A eject the sheet onto the sheet receiving tray 18.

The image forming apparatus 100 also has the sheet transport path F2 extending from the manual sheet feeding tray 17 to the registration rollers 19. Along the sheet transport path F2, a pick-up roller 17A, a sheet feeding roller 17B, a separating pad 17C are arranged. The pick-up roller 17A picks up and feeds sheets that are stored in the manual sheet feeding tray 17, one at a time, into the sheet transport path F2. The separating pad 17C is similar in configuration to the separating pad 16C.

A sheet detector 31, which is similar in configuration to the sheet detector 30, is provided immediately downstream of the separating pad 17C along the sheet transport path F2. The detector 31 detects whether a sheet is properly fed from the manual sheet feeding tray 17. When the detector 30 detects a failure in feeding a sheet, the control section 50 drives the pick-up roller 17A again in order to refeed the same sheet. The control section 50 also changes rotation speeds of the transport rollers R2 based upon a calculated number of attempts made to refeed the same sheet. In addition, the sheet transport path of the invention includes the sheet transport path F2 extending from the manual sheet feeding tray 17 to the registration rollers 19.

Also provided is the sheet transport path F3 extending from the sheet eject rollers 18A to upstream of the registration rollers 19 on the sheet transport path F1. The sheet eject rollers 18A are rotatable in forward and backward directions. In single-side image formation, and in image formation on a second side of a sheet in double-side image formation, the sheet eject rollers 18A are rotated in the forward direction, so that the sheet is ejected onto the sheet receiving tray 18.

In image formation on a first side of the sheet in the double-side image formation, the sheet eject rollers 18A are first rotated in the forward direction until a tail end of the sheet passes through the fusing device 15. Then, with the tail end nipped therebetween, the eject rollers 18A are rotated in the backward direction to feed the sheet into the sheet transport path F3. Thus, in the double-side image formation, the sheet having an image formed on the first side thereof is fed into the sheet transport path F1, the tail end first, with the second side facing the side of the drive roller 11A.

Between the second transfer roller 14 and the intermediate transfer belt 11, the registration rollers 19 feed a sheet as fed either from the sheet feeding cassette 16 or the manual sheet feeding tray 17, or through the sheet transport path F3, in synchronized timing with the rotation of the intermediate transfer belt 11. At the time the photoreceptor drums 101A to 101D and the intermediate transfer belt 11 start rotating, the registration rollers 19 have their own rotation stopped. Thus, transport of a sheet which is fed or is being transported before the intermediate transfer belt 11 initiates rotating is stopped, with a leading end thereof in contact with the registration rollers 19. Then, when the leading end of the sheet and a leading end of the toner image formed on the intermediate transfer belt 11 meet each other at the contact position of the second transfer roller 14 and the intermediate transfer belt 11, the registration rollers 19 initiate rotating.

In full-color image formation involving toner image formation performed in all the image stations PA to PD, the first transfer rollers 13A to 13D press the intermediate transfer belt 11 against all the photoreceptor drums 101A to 101D, respectively. In the monochromatic image formation involving toner image formation performed only in the image station PA, only the first transfer roller 13A presses the intermediate transfer belt 11 against the photoreceptor drum 101A.

Figure 2A:
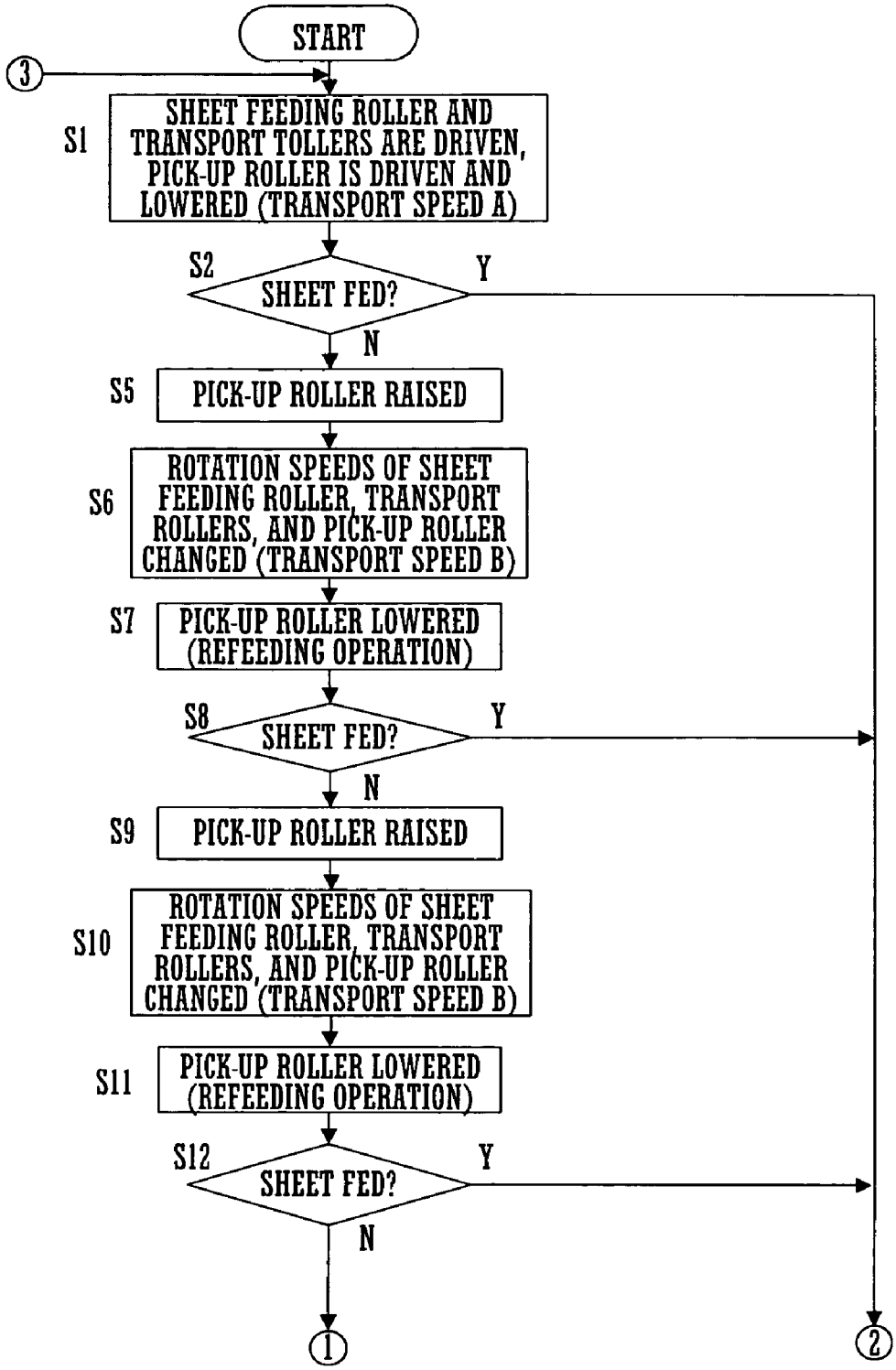
FIGS. 2A and 2B collectively constitute a flowchart illustrating a process in which a sheet is fed from a sheet feeding cassette provided in the image forming apparatus.
Figure 2B:
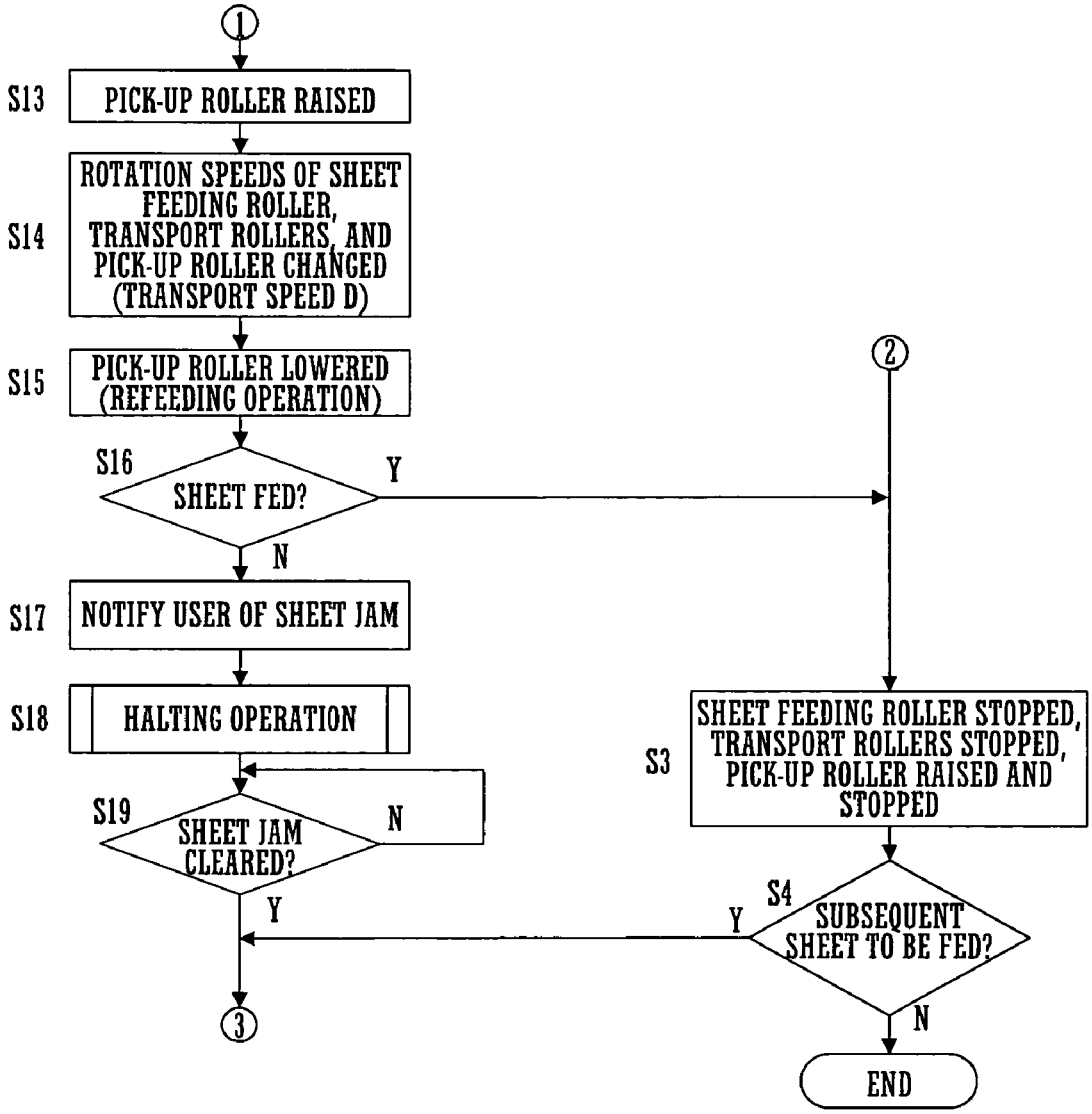

FIGS. 2A and 2B collectively constitute a flowchart illustrating a process in which a sheet is fed from the sheet feeding cassette 16. A sheet is fed in a similar manner both from the sheet feeding cassette 16 and from the manual sheet feeding tray 17. Accordingly, a process in which a sheet is fed from the cassette 16 is described below.

When image formation is initiated, the pick-up roller 16A is driven and lowered, and the sheet feeding roller 16B and the transport rollers R1, R2 are driven (step S1), so that a sheet stored in the sheet feeding cassette 16 is fed into the sheet transport path F1. The pick-up roller 16A is lowered by turning on a not-shown solenoid. The sheet feeding roller 16B and the transport rollers R1, R2 are driven by driving not-shown motors which are connected to the respective rollers. The pick-up roller 16A is driven by rotational force of the sheet feeding roller 16B transmitted through an endless belt 16D. Driving forces of the respective drive motors of the pick-up roller 16A, the sheet feeding roller 16B, and the transport rollers R1, R2 are adjusted so that the sheet is transported at transport speed A as illustrated in FIG. 3.

Then, determination is made on whether the sheet is fed into the sheet transport path F1 (step S2). In the present embodiment, after a predetermined period of time during which the sheet detector 30 outputs no signal indicating presence of a sheet, determination is made that there is no sheet fed. If the sheet detector 30 outputs a signal indicating presence of a sheet within the predetermined time period, determination is made that the sheet is fed.

When determination is made in step S2 that a sheet is fed into the sheet transport path F1, the solenoid is turned off in order to raise the pick-up roller 16A. The respective drive motors of the sheet feeding roller 16B and the transport rollers R1 and R2 are stopped to stop driving the pick-up roller 16A, the sheet feeding roller 16B, and the transport rollers R1 and R2 (step S3). Then, determination is made on whether a subsequent sheet is to be fed (step S4). If determination is made that the subsequent sheet is to be fed, the process returns to step S1. If determination is made that the subsequent sheet is not to be fed, the process is terminated.

Figure 4:
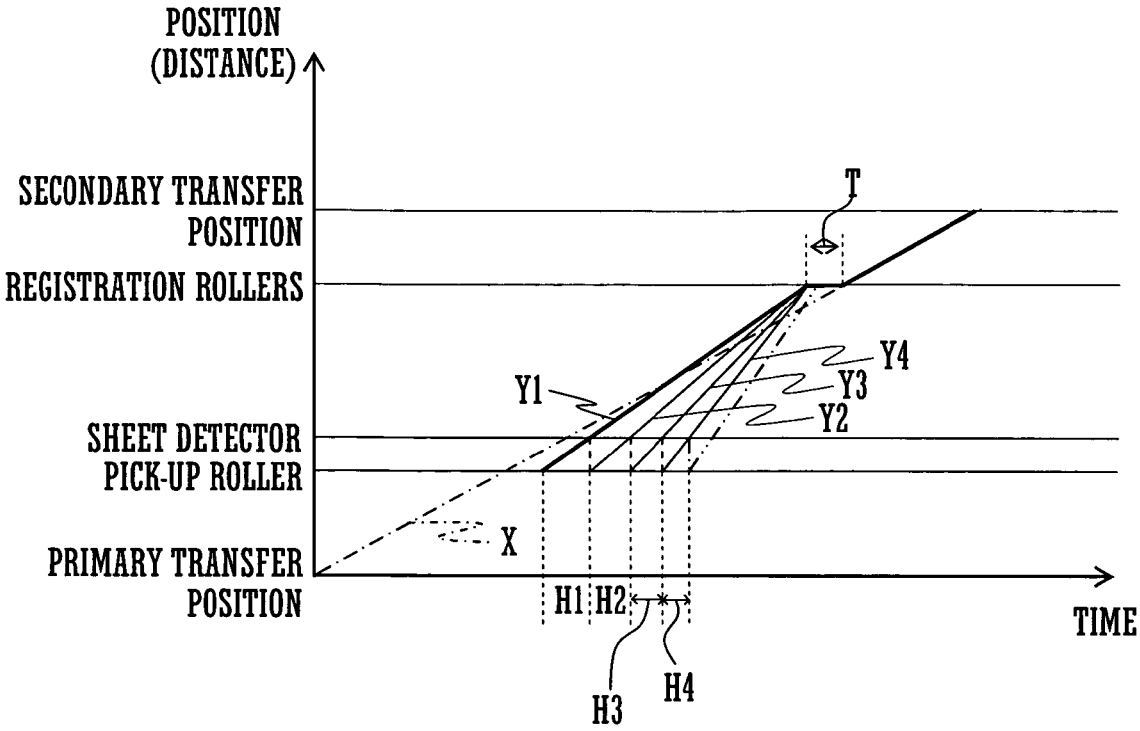
FIG. 4 is a graph illustrating relationships between respective transport times, and positions, of a sheet and a toner image.

If determination is made in step S2 that no sheet is fed into the path F1, the solenoid is turned off in order to raise the pick-up roller 16A (step S5). Then, the driving forces of the respective drive motors of the pick-up roller 16A, the sheet feeding roller 16B, and the transport rollers R1 and R2 are adjusted so that the sheet is transported at transport speed B as illustrated in FIG. 4 (step S6). Subsequently, the solenoid is turned on again in order to lower the pick-up roller 16A which is being driven (step S7), in an attempt to refeed the sheet which fails to have been fed. Next, determination is made on whether the sheet is fed into the sheet transport path F1 (step S8), as in step S2. If determination is made that the sheet is fed, the process proceeds to step S3.

If determination is made in step S8 that the sheet is not fed, another attempt is made to refeed the sheet, as in steps S5 to S7. More specifically, the solenoid is turned off in order to raise the pick-up roller 16A (step S9). Then, the driving forces of the respective drive motors of the pick-up roller 16A, the sheet feeding roller 16B, and the transport rollers R1 and R2 are adjusted so that the sheet is transported at transport speed C as illustrated in FIG. 4 (step S10). Subsequently, the solenoid is turned on again in order to lower the pick-up roller 16A which is being driven (step S11).

Next, determination is made on whether the sheet is fed into the sheet transport path F1 (step S12), as in step S2. If determination is made that the sheet is fed, the process proceeds to step S3. If determination is made in step S12 that the sheet is not fed, still another attempt is made to refeed the sheet, as in steps S5 to S7. More specifically, the solenoid is turned off in order to raise the pick-up roller 16A (step S13). Then, the driving forces of the respective drive motors of the pick-up roller 16A, the sheet feeding roller 16B, and the transport rollers R1 and R2 are adjusted so that the sheet is transported at transport speed D as illustrated in FIG. 4 (step S14). Subsequently, the solenoid is turned on again in order to lower the pick-up roller 16A which is being driven (step S15).

Next, determination is made on whether the sheet is fed into the sheet transport path F1 (step S16), as in step S2. If determination is made that the sheet is fed, the process proceeds to step S3. If determination is made in step S16 that the sheet is not fed, determination is made that there is a sheet jam. A user is notified of the sheet jam through a not-shown notifying device, such as a display device, provided in the image forming apparatus (step S17). Alternatively, a user may be notified of the sheet jam through an alarm sound.

Then, operations for halting image formation, such as cleaning toner images off the photoreceptor drums 101A to 101D or the intermediate transfer belt 11, are performed (step S18). The process is suspended until determination is made that the sheet jam is cleared (step S19). If determination is made in step S19 that the sheet jam is cleared, the process returns to step S1.

As described above, the image forming apparatus of the invention makes up for a delay in feeding a sheet caused by a failure or failures in feeding the sheet, by increasing sheet transport speed of the pick-up roller 16A, the sheet feeding roller 16B, and the transport rollers R1 and R2 incrementally from the transport speed A to the transport speeds B to D as shown in FIG. 3 each time a sheet is refed by the pick-up roller 16A, i.e., each time a refeeding operation is performed. The transport speeds B to D are set according to number of sheet feeding failures, in consideration of timing at which the refeeding operation is to be performed, with reference to the transport speed A, i.e., a normal transport speed to be used when a sheet is properly fed with no failure.

The transport speeds B to D as set render transport times Y2 to Y4 equal to transport time Y1, as shown in FIG. 4. The transport time Y1 is time taken from initiation of feeding a sheet, i.e., from initiation of driving the pick-up roller 16A, to arrival of the sheet at the registration rollers 19. The transport times Y2 to Y4 are times taken from initiation of feeding a sheet to arrival of the sheet at the registration rollers 19 after one or more failures.

Illustrated in FIG. 4 is a relationship between the transport times Y1 to Y4 and transport time X. The transport time X is time that a toner image takes to be transported at a process speed as shown in FIG. 3 from the primary transfer position in the image station PA to the secondary transfer position. More specifically, the transport time Y1 is time that a sheet takes to be transported at the transport speed A used for first sheet feeding with no preceding failure. The transport time Y2 is time that the sheet takes to be transported at the transport speed B used for second sheet feeding. The transport time Y3 is time that the sheet takes to be transported at the transport speed C used for third sheet feeding. The transport time Y4 is time that the sheet takes to be transported at the transport speed D used for fourth sheet feeding.

Thus, a sheet that has experienced one or more feeding failures can be transported to the secondary transfer position in exact timing with transport to the secondary transfer position of toner images which are formed in the image stations PA to PD and superposed on one another. Even after one or more feeding failures, a sheet can be transported to the secondary transfer position in time for superimposed toner images to be transferred to the sheet.

In the image forming apparatus 100 according to the present embodiment, the sheet transport path F1 extending from the sheet feeding cassette 16 to the secondary transfer position is shorter than a distance between the secondary transfer position and the primary transfer position in the image station PA which is located most upstream in a direction in which the intermediate transfer belt 11 transports a toner image. Formation of a toner image is initiated at an earlier timing than feeding a sheet from the sheet feeding cassette 16 is initiated, as shown in FIG. 4, and thus the toner image is formed at an earlier timing than the sheet is fed. Therefore, part of the toner image is already formed when a sheet feeding failure occurs. Accordingly, it is effective to vary sheet transport speeds depending on number of sheet feeding failures. This is true of most image forming apparatus using the tandem-type intermediate transfer method.

Further, when a predetermined number (e.g., four, as in the present embodiment) of sheet feeding failures occurs, image forming operation is halted and an operator is notified, through the display device, that there occurs a sheet jam. Accordingly, excessive repeating of sheet refeeding is avoided, so that load on the pick-up roller 16A is reduced. Also, the user notified of the failure can deal with the sheet jam immediately.

As shown in FIG. 4, the sheet as transported is held by the registration rollers 19 for time T and then transported to the secondary transfer position. Accordingly, shortening the time T allows for an increase in number of refeeding operations to be repeated. However, the number of refeeding operations should be determined so as not to have a negative effect on sheet transport performance. This is because transfer timing adjustment, sheet skew correction, and the like, are performed by the registration rollers 19 holding a sheet.

Referring to FIG. 4, there is an interval between initiation of a sheet feeding operation and initiation of a following refeeding operation (hereinafter merely as a refeeding interval). In the present embodiment, intervals H1 to H4, which are refeeding intervals for the first to fourth refeeding operations, respectively, are shorter in the mentioned order. It is because sheet detection time is made shorter gradually as the number of refeeding operations increases, so that it takes increasingly shorter for a sheet to be detected after being fed. Length of sheet detection time is set in consideration of time that the as-fed sheet takes to reach a position where the sheet detector 30 makes a sheet detection. Since the sheet transport speed is increased incrementally as the number of refeeding operations increases, the as-fed sheet takes a shorter time to reach the sheet detection position and, thus, can be properly detected in a shorter time.

In the present embodiment, the sheet transport speeds of the pick-up roller 16A, the sheet feeding roller 16B, and the transport rollers R1 and R2 are changed according to the number of refeeding operations before determination is made that a sheet is properly fed, i.e., before the sheet detector 30 detects a sheet as fed. Alternatively, the sheet transport speeds may be changed according to the number of refeeding operations after determination is made that a sheet is properly fed.

The image forming apparatus 100 according to the embodiment of the invention is not limited to a multi-color image forming apparatus using a tandem-type intermediate transfer method, but may be a monochromatic image forming apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a storage device for storing sheets;

a pick-up device for feeding a sheet from the storage device into a sheet transport path which extends from the storage device to a transfer position where a developer image is transferred to a sheet;

a transporting device for transporting a sheet at variable speeds along the sheet transport path;

a detecting device for detecting whether a sheet is properly fed from the storage device by the pick-up device, the detecting device being positioned downstream of the pick-up device along the sheet transport path; and a control device for driving the pick-up device to feed a sheet again when the detecting device detects that said sheet is not fed into the sheet transport path and for varying sheet transport speed of the transporting device depending on number of attempts made to feed said sheet.

2. An image forming apparatus according to claim 1, further comprising:

a plurality of image stations for forming developer images respectively, the image stations being arranged in alignment with one another; and an intermediate transferring member for transporting to the transfer position the developer images which are transferred to the intermediate transferring member at a plurality of intermediate transfer positions facing the respective image stations.

3. An image forming apparatus according to claim 2, wherein the sheet transport path is shorter than a distance between the transfer position and the intermediate transfer position that is located most upstream along a direction in which the intermediate transferring member transports a developer image.

4. An image forming apparatus according to claim 1, further comprising a notifying device for notifying a user of a failure in feeding a sheet, wherein, when a predetermined number of attempts to feed said sheet are made, the control device controls the pick-up device to stop feeding said sheet, activates the notifying device, and stops forming a developer image to be transferred on said sheet.

5. An image forming apparatus according to claim 1, further comprising a separating member for separating sheets as fed by the pick-up device from one another so that one sheet at a time is fed into the sheet transport path, wherein the detecting device is positioned immediately downstream of the separating member along the sheet transport path, the detecting device being positioned between the separating member and the most upstream part of the transporting device.

6. A sheet transport method, comprising:

detecting whether a sheet is fed from a storage device into a sheet transport path;

feeding a sheet again when detection is made that said sheet is not fed into the sheet transport path; and counting number of attempts to feed said sheet; and varying sheet transport speeds according to the counted number.

7. An image forming apparatus according to claim 1, wherein the number of attempts made to feed said sheet are detected by said detecting device.

8. A sheet transport method according to claim 6, wherein, said varying sheet transport speeds according to the counted number further comprises increasing the sheet transport speed after a detection is made that said sheet is not fed into the sheet transport path.

9. A sheet transport method according to claim 6 further comprising:

stopping forming a developer image to be transferred onto said sheet when a predetermined number of detections are made that said sheet is not fed into the sheet transport path.

10. A sheet transport method according to claim 6 further comprising:

stopping feeding said sheet into the sheet transport path when a predetermined number of detections are made that said sheet is not fed into the sheet transport path.

11. A sheet transport method according to claim 6, wherein, said varying transport speeds according to the counter number further comprises a maximum of four speed increases in transport speed.

12. A sheet transport method according to claim 9, wherein, said predetermined number of detections is four.

13. A sheet transport method according to claim 10, wherein, said predetermined number of detections is four.

* * * * *